US007025322B2

(12) United States Patent
Biester

(10) Patent No.: US 7,025,322 B2
(45) Date of Patent: Apr. 11, 2006

(54) BLOWOUT VALVE ASSEMBLY

(75) Inventor: Klaus Biester, Wienhausen (DE)

(73) Assignee: Cooper Cameron Corporation, Houston, TX (US)

( * ) Notice: Subject to any disclaimer, the term of this patent is extended or adjusted under 35 U.S.C. 154(b) by 93 days.

(21) Appl. No.: 10/415,443

(22) PCT Filed: Oct. 30, 2001

(86) PCT No.: PCT/EP01/12552

§ 371 (c)(1),
(2), (4) Date: Sep. 15, 2003

(87) PCT Pub. No.: WO02/36933

PCT Pub. Date: May 10, 2002

(65) Prior Publication Data

US 2004/0031940 A1 Feb. 19, 2004

(30) Foreign Application Priority Data

Oct. 30, 2000 (DE) ..... 200 18 561 U

(51) Int. Cl.
*B65B 1/04* (2006.01)

(52) U.S. Cl. ..... 251/1.3

(58) Field of Classification Search ..... 251/1.1–1.3, 251/248–250.5; 92/DIG. 4, 13.3, 13.1
See application file for complete search history.

(56) References Cited

U.S. PATENT DOCUMENTS

| | | | | |
|---|---|---|---|---|
| 2,877,977 | A | 3/1959 | Allen | 251/1 |
| 3,215,393 | A * | 11/1965 | Allen | 251/1.3 |
| 3,319,923 | A | 5/1967 | Haeber et al. | 251/1 |
| 4,848,472 | A | 7/1989 | Hopper | 166/344 |
| 5,505,426 | A * | 4/1996 | Whitby et al. | 251/1.3 |
| 5,653,418 | A * | 8/1997 | Olson | 251/1.3 |

* cited by examiner

*Primary Examiner*—Steven O. Douglas
(74) *Attorney, Agent, or Firm*—Conley Rose, P.C.

(57) ABSTRACT

The invention relates to a blowout valve assembly (blowout preventer (BOP)) comprising a connecting channel, which can be closed by at least one closing device, whereby the closing device can be transversally displaced with regard to the connecting channel by means of a drive device. The aim of the invention is to further improve a blowout valve assembly of this type in order to enable this assembly to be precisely and easily actuated by remote control and while, at the same time, reliably preventing an unintentional opening of the closing device. To this end, the drive device comprises at least two electric motors, which can be operated individually or in a synchronized manner, and comprises a transmission device having at least one irreversible transmission unit. In order to displace the closing device, said transmission unit is drive-connected to both electric motors.

38 Claims, 5 Drawing Sheets

BLOWOUT VALVE ASSEMBLY

BACKGROUND OF THE INVENTION

The invention relates to a blowout valve assembly, i.e. a so-called blowout preventer (BOP), with a connecting channel which can be closed by at least one closing device, whereby the closing device can be transversally displaced with regard to the connecting channel by means of a drive device.

Such a blowout valve assembly is used both with terrestrial and maritime mineral oil or natural gas drilling wells. The blowout valve assembly is used to prevent an uncontrolled blowout of the mineral oil or natural gas which is conveyed under high pressure along the pipe lines. To achieve this, the blowout valve assembly comprises at least one closing device. A connecting channel of the blowout valve assembly is arranged in the pipe line, whereby the conveyed mineral oil or natural gas also passes through this connecting channel. The closing device can be transversally displaced with regard to the connecting channel and is displaced if necessary by a drive device so far in the direction of the connecting channel that it is closed and an uncontrolled blowout of mineral oil or natural gas is prevented.

With the blowout valve assembly known in practice the drive device operates hydraulically. Consequently, the blowout valve assembly must have available an appropriate pipe system for the supply of the hydraulic fluid, and appropriate hydraulic devices for operating this blowout valve assembly, more of these arrangements or also more devices for mineral oil and natural gas supply must be arranged outside of the blowout valve assembly. The drive device is therefore quite complicated.

A further disadvantage in this connection is that whereas a large force can be applied by a hydraulic drive device, it cannot be controlled precisely. It can therefore arise that the closing device either does not shut off sufficiently tightly or shuts off too tightly so that it can hardly be opened again. In addition, a slow and partial opening of the closing device is not always possible with a hydraulic drive device.

BRIEF SUMMARY OF THE PREFERRED EMBODIMENTS

The object of the invention is therefore to improve a blowout valve assembly of the type mentioned in the beginning such that it can be actuated remotely in an exact and simple manner and at the same time unintentional opening of the closing device is reliably prevented. This object is solved in relation to the characteristics of the generic terms of claim 1 in that the blowout valve assembly comprises at least two electric motors, which can be operated individually or in a synchronized manner and comprises a transmission device having at least one irreversible transmission unit, which is drive-connected to both electric motors to displace the closing device.

Through the electrical actuation of the blowout valve assembly appropriately complex pipe systems for a hydraulic fluid (external pipes supplying these pipes), a hydraulic fluid source and similar equipment can be replaced by an electrical drive device. The said drive device is connected in a simple manner via electrical feeder cables and can especially be controlled from a remote position. The electrical motors can be operated singly and redundantly or also synchronously and simultaneously. Due to the irreversible transmission unit of the transmission device the blowout valve assembly is, for example, reliably prevented from unintentionally opening when the electric motors are switched off. The irreversible property is only cancelled after the application of a suitable release element by the electric motor or motors and the blowout valve assembly can be displaced for partial or full opening of the connecting channel.

In order to obtain electric motors which can be exactly controlled and, with regard to torque and speed, monitored, the said motors can be formed as servomotors, especially as direct current servomotors. Such motors exhibit high reliability and high efficiency.

In order to be able to control and monitor the electric motors also separately, each electric motor can be electrically connected to a separate control device.

The irreversible transmission unit can be formed in various ways. One example is a planetary gear or similar. To render the transmission unit simple and reliable, it can be a worm gear comprising at least a worm and worm wheel, whereby the worm wheel is associated with the closing device and the worm is associated with the electric motors. Such a worm gear is inherently irreversible, whereby the irreversible property can also be realized in both displacement directions of the transmission.

In order to be able to directly drive the worm from the electric motors, the worm can be arranged on a worm shaft which is drive-connected to both electric motors.

One possible arrangement of the electric motors can be seen in that the said motors are arranged behind one another at one end of the worm on the worm shaft. A further possible arrangement can be seen in that the electric motors are drive-connected to the opposite ends of the worm shaft.

In the simplest case and without the use of additional motor shafts, which would have to be connected to the worm shaft, each end of the worm shaft can be rotationally rigidly connected to one of the electric motors as its motor shaft.

In order to enable a still higher gear ratio and to enable the transfer of a still higher torque or a larger force to the closing device by the electric motors, the transmission device can comprise at least one screw drive comprising at least a screw drive nut and a rotating spindle, whereby the worm wheel is rotationally rigidly connected to the screw drive nut or the rotating spindle.

One example of such a screw drive is a ball screw drive. Here, the screw drive nut is formed as a ball nut and the rotating spindle as a recirculating ball screw spindle.

In order to obtain a screw drive with a high load-bearing capacity, long service life, highest reliability and for adverse ambient conditions, the screw drive can be a roll screw drive.

In order to increase the load-bearing capacity of the screw drive and to construct the said drive very ruggedly, the roll screw drive can be a planetary roll screw drive.

With the blowout valve assembly known from practice the closing device comprises at least one closing element in the form of a closing wedge or closing jaw. According to the invention, the construction can be simplified in that the rotating spindle of the screw drive is connected to the closing element of the closing device.

In order to be able to design the blowout valve assembly still more compact and to be able to dispense with any intermediate parts between the rotating spindle and the closing element, the rotating spindle can be formed as part of the closing device and can exhibit the closing element at its end facing the connecting channel. Here, the rotating spindle and the closing element can be connected together in a manner which facilitates their release.

With one embodiment of a blowout valve assembly the closing element is supported in a suitable device housing transverse to the connecting channel and connected with the rotating spindle. In order to be able to displace the rotating spindle in a simple manner together with the closing element in the direction of the connecting channel, the screw drive nut can be supported in the device housing so that it can rotate, but cannot be moved axially. A rotational movement is transferred to the screw drive nut via the worm drive and converted into a linear movement by the said worm drive in combination with the rotating spindle due to the fixed axial position of the screw drive nut in the device housing.

In order to be able to use commercially available screw drives and corresponding screw drive nuts, appropriate adaptations relative to the device housing can be achieved, especially in that the screw drive nut is arranged rotationally rigidly in a bearing sleeve which can be rotated in the device housing, but which is supported so that it cannot be moved axially. The bearing sleeve is primarily used as adapter for arranging the screw drive nut in the device housing, whereby the connection between the bearing sleeve and screw drive nut can, for example, occur by shrinking on or also by the releasable attachment of the screw drive nut within the bearing sleeve. The internal dimensions of the bearing sleeve can be varied to accommodate different screw drive nuts, whereas the appropriate external dimensions of the bearing sleeve are always ready-made for the corresponding device housing.

In order to transfer the driving force transferred from the electric motors through the worm gear as directly as possible to the screw drive nut, the worm wheel can be connected rotationally rigidly to the screw drive nut and/or the bearing sleeve. Consequently, there is especially the possibility of arranging the worm gear very close to the screw drive. Of course, there is also the possibility of providing or connecting the screw drive nut and/or bearing sleeve with external teeth which engage corresponding external teeth on the worm wheel. With regard to the worm wheel it should be noted that the worm wheel can be, for example, a globoid worm wheel or a spur wheel and correspondingly the worm can be a cylindrical worm or a globoid worm.

A simple method of rotationally supporting the bearing sleeve with screw drive nut and simultaneously for the axial fixation of both of them can be seen when the bearing sleeve is rotationally supported using at least one axial bearing in the device housing. The axial bearing can be a roller bearing and especially a spherical roller bearing. The latter can also accept appropriately high axial forces as well as high radial forces.

In order to arrange the electric motors independently of the device housing and to simplify access to the said motors, the electric motors can be arranged on both sides with respect to the device housing and especially in motor housings which can be flange-connected to the said device housing.

In order to be able to accommodate the worm shaft in the device housing and in the close vicinity of the screw drive, the worm shaft can be rotationally supported in a transverse hole running approximately tangentially to the longitudinal hole of the device housing, the said longitudinal hole accommodating the rotating spindle and screw drive nut. The appropriate motor housings for accommodating the electric motors can be connected to the side of this transverse hole.

In order to enable secure closing of the connecting channel, especially at the high pressures in mineral oil production, which may be up to many hundreds of bar, two closing elements which can move towards one another can be supported in the device housing and at least one screw drive, one worm gear and two electrical motors can be assigned to each closing element. Through appropriate synchronization of the movement, both closing elements can be moved towards one another simultaneously and synchronously for closing the connecting channel. Correspondingly, it is possible to move the closing elements back using the electric drive devices slowly and partially or completely from their closed position for opening the connecting channel.

In order to be able to apply a still higher force for closing the blowout valve assembly, each closing element can be connected, especially in a releasable manner, to an advance shaft which is connected at its end section, which points away from the closing element, to a transverse beam arranged transversally to its longitudinal axis, the said transverse beam being connected on both sides to the advance shaft with a left and a right screw drive. Consequently, the transverse beam can be moved simultaneously by two screw drives. The movements of the two screw drives can occur through connections to a worm gear and two electric motors associated with it.

However, in order to substantially increase the force acting through the screw drives, a worm gear and two electric motors can be assigned to each of the left and the right screw drives.

With a blowout valve assembly with two closing elements which can move towards one another four screw drives, four worm drives and a total of eight electric motors can be used in this case. However, to simplify the construction the worm wheel, for example, assigned to the left screw drive can be arranged approximately centrally between two rotating spindles and rotationally rigidly connected to them, whereby the thread pitch on the rotating spindles is opposing and a screw drive nut is arranged on each rotating spindle, the said screw drive nut being connected appropriately to the relevant transverse beam of the closing elements which can move towards one another. In this manner, only two worm gears each with two electric motors are needed for the left and right screw drives of the two closing elements. Here, in each case one worm gear is used for the actuation of two left or correspondingly two right screw drives.

The linear movement produced via the screw drives is transferred via the transverse beams to the two closing elements which can be moved towards one another. In the previously described embodiment the worm wheel is rotationally rigidly connected to the rotating spindles, so that correspondingly the screw drive nut executes the linear movement. To prevent the screw drive nut in this relationship from rotating, the screw drive nut can be rotationally rigidly guided along the rotating spindle in a transmission housing in the longitudinal direction of the rotating spindle.

In order to translate the linear movement of the screw drive nut along the rotating spindle in a simple manner to an appropriate linear movement of the transverse beams, the screw drive nut can be held in an essentially tube-shaped retaining sleeve, which comprises at least one sliding section which can be rotationally rigidly displaced along the transmission housing. The tube-shaped retaining sleeve can be attached to a transverse beam at its free end. The rotationally rigid support of the screw drive nut does not occur in this connection through a direct action between the screw drive nut and the transmission housing, but instead via the rotationally rigid guidance of the sliding section of the retaining sleeve.

In this connection, the construction can furthermore be simplified in that, where applicable, the sliding section is formed at the end of the retaining sleeve facing the rotating spindle and the screw drive nut is rotationally rigidly held in it. In this way retaining sleeves with the least possible length can be used.

The rotationally rigid mounting can consequently be realized in a simple manner if the sliding section is essentially quadrilateral appropriate to a cross-section of a guide hole in the transmission housing. One possibility for such a quadrilateral cross-section is, for example, a quadratic or rectangular shape.

In order to prevent the sliding section from jamming inside the guide hole and to also reduce the friction when the sliding section slides along the guide hole, sliding plates can be especially arranged on all four outer sides of the sliding section. The said sliding plates slide along corresponding inner sides of the guide hole and thereby reduce the friction during the displacement of the retaining sleeve along the transmission housing.

A retaining sleeve of sufficient strength can be especially obtained if the retaining sleeve exhibits an essentially circular shaped cross-section except on its sliding section and protrudes from one end of the transmission housing and is there attached especially in a releasable manner to the transverse beam at its free end.

A simple method of attaching the retaining sleeve and the transverse beam can be seen in that the end of the retaining sleeve and transverse beam are screwed together.

In order to be able to accommodate the electric motors in a simple way with the side arrangement of the said motors to the device housing and to render them separately accessible, the electric motors can be arranged especially in pairs in a motor housing extending transversely and essentially tangentially to the transmission housing.

In order that the worm wheel can be rotationally rigidly connected in a simple manner to the two assigned rotating spindles, the worm wheel can be rotationally rigidly arranged on a connecting rotational sleeve and, on its two ends, ends of the rotating spindle can be attached with opposing screw pitch. The connecting rotational sleeve also permits worm wheels of larger diameters so that the gear ratio can be further increased. In addition the connecting rotational sleeves permit a simple attachment of the rotating spindle in that, for example, it is screwed into them with its ends facing the connecting rotational sleeve.

With one embodiment of the blowout valve assembly according to the invention in which the electric motors are employed simultaneously, an appropriate synchronization of the movements of the motors is necessary. An essentially mechanically based synchronization is extremely difficult for reasons of production, because deviations in the construction of the motors, worm shaft, worm, worm wheel, screw drives, etc. can hardly be avoided. According to the invention, the synchronization of the electric motors therefore occurs by software, especially via their control devices.

A simple method of synchronization using software can be seen in that one electric motor is wired as the master and the other electric motors as slaves or also all electric motors are wired as masters.

BRIEF DESCRIPTION OF THE DRAWINGS

In the following, advantageous embodiments of the invention are explained in more detail based on the figures in the enclosed drawing.

The following are shown.

DETAILED DESCRIPTION OF THE PREFERRED EMBODIMENTS

Figure 1:
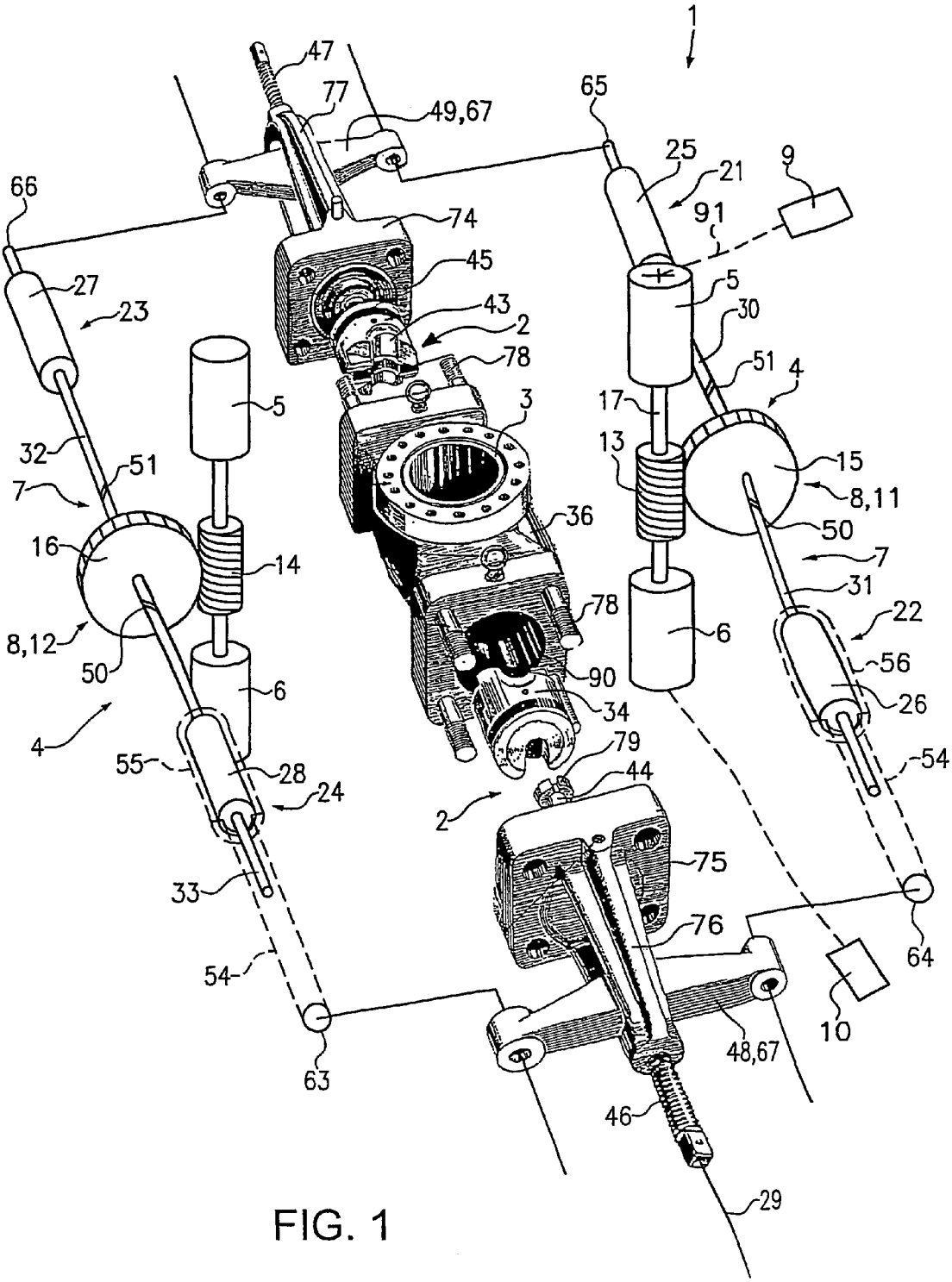
FIG. 1 shows a perspective plan view as an exploded view of a blowout valve assembly according to a first embodiment.

FIG. 1 shows a perspective plan view from diagonally above onto an exploded view of an embodiment of a blowout valve assembly 1. This comprises a device housing 36 centrally along a longitudinal axis 29 in which a connecting channel 3 is formed. When the blowout valve assembly 1 is inserted into a pipe line, for example in mineral oil production, the said channel forms part of the pipe line through which the supplied mineral oil flows.

A closing hole 90, in which two closing elements 34, 43, which can be moved towards one another, are supported as part of a closing device 2, extends transverse to the connecting channel 3 in the device housing 36. The closing elements 34, 43 are formed by closing jaws which engage one another in the region of the connecting channel 3 and close it off completely.

The closing elements 34, 43 are releasably connected to the advance shafts 44, 45 on their rear sides which are positioned opposite the connecting channel 3. On one end of the advance shafts facing the corresponding closing element, there is a connection adapter 79 arranged, via which the advance shaft and closing element are attached together. The advance shafts also extend in the direction of the longitudinal axis 29 through the housing cover 74, 75 and terminate outside of approximately V-shaped arms 76, 77. The said arms are attached to the housing covers 74, 75 by the ends of their V-legs. The housing covers 74, 75 can be attached to the device housing 36 via threaded studs 78 and suitable nuts which are not shown.

Within the end arms 76, 77 a yoke 67 as cross-beam 48, 49 protrudes from the advance shafts 44, 45 transverse to the longitudinal axis 29. This yoke exhibits holes in both of its outer positioned ends into which the ends 63, 64, 65, 66 of retaining sleeves 54, where applicable, can be partially inserted and attached by threaded studs.

The retaining sleeves 54 extend parallel to the longitudinal axis 29 and exhibit a sliding section 55, 56, enlarged in diameter, opposite their ends 63 to 66. A screw drive nut 25 to 28 is held rotationally rigidly in this sliding section 55, 56, which is preferably quadrilateral in cross-section. The appropriate screw drive nuts 25 to 28 form a part of the screw drives 21 to 24. A rotating spindle 30 to 33 is rotationally supported in each of the screw drive nuts 25 to 28.

With the embodiment illustrated in FIG. 1 the relevant rotating spindles 30 to 33 extend from the screw drive nuts 25 to 28 to worm wheels 15, 16. These worm wheels are rotationally rigidly connected to both rotating spindles 30, 31 respectively 32, 33 which are each adjacent in the direction of the longitudinal axis 29.

The worm wheels 15, 16 each form part of worm gears 11, 12 forming transmission units 8. The other part of the worm gear is formed by an appropriate worm 13, 14, which engages an appropriately toothed corresponding worm wheel 15, 16 via appropriate outer teeth. The worms 13, 14 are arranged on appropriate worm shafts 17, 18. These are connected with their shaft ends 19, 20, see also the other figures, to electric motors, especially direct current servomotors. One electric motor drives each corresponding shaft end of one of the worm shafts.

In one embodiment of the invention each of the electric motors can be connected to control devices 9, 10 positioned remote with respect to the blowout valve assembly using appropriate electrical connecting lines 91. In one embodiment of the invention each electric motor is provided with its own control device.

The appropriate threads of the rotating spindles 30, 31, respectively 32, 33, exhibit correspondingly opposing pitches so that with the transmission device 7 positioned to the right of the device housing 36 in FIG. 1 the screw drive nut 25 moves in the opposite direction along the longitudinal axis 29 as the screw drive nut 26 when the associated worm wheel 15 rotates. This applies analogously to the transmission device 7 illustrated in FIG. 1 to the left of the device housing 36.

It should be noted that of course appropriate control devices for the supply of each of the electric motors are also provided for the electric motors 5 and 6 in the transmission device 7 illustrated to the left.

Figure 2:
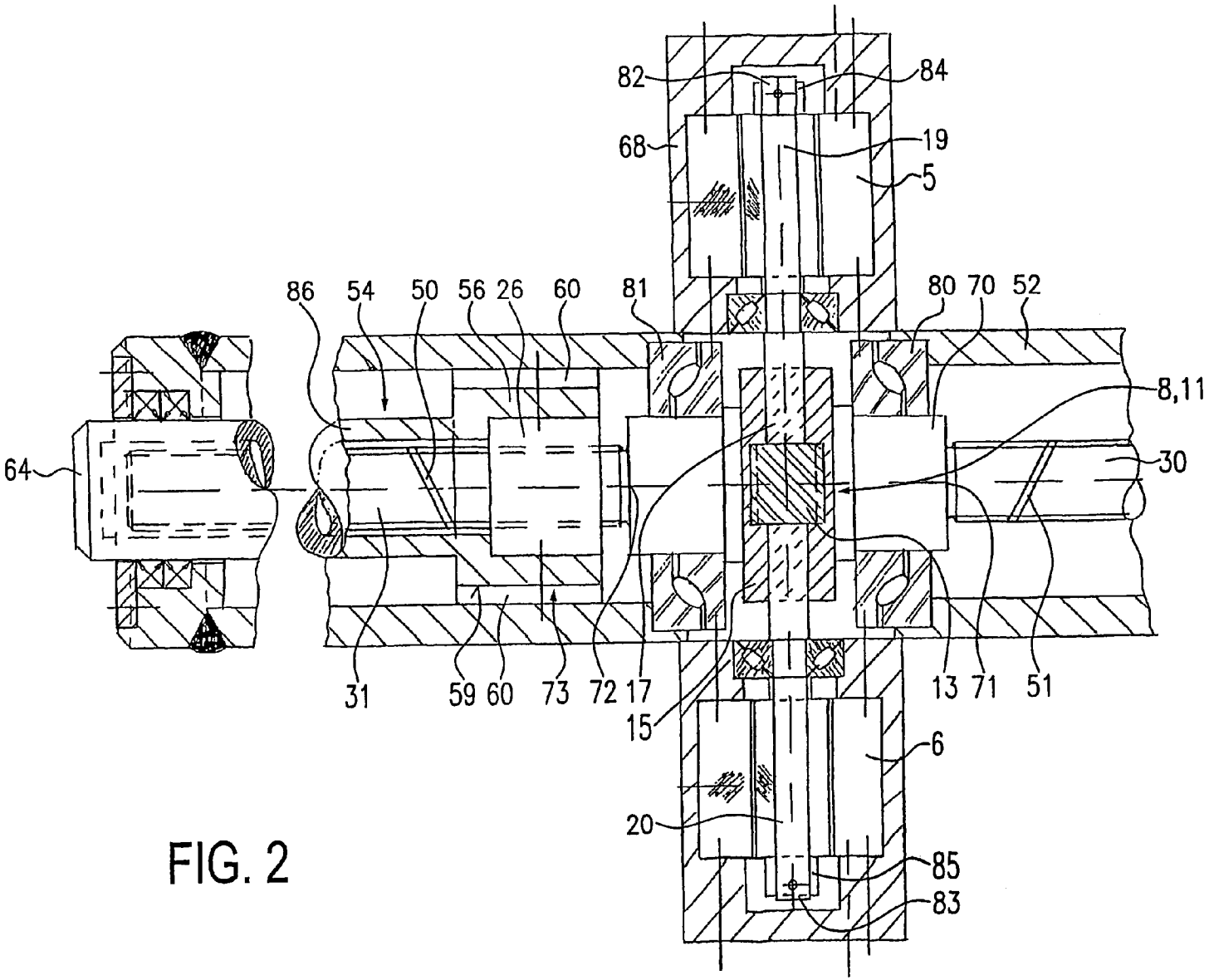
FIG. 2 shows a side view of a drive device in a cut-away view with transmission for the blowout valve assembly according to FIG. 1.

In FIG. 2 a side view of a longitudinal section through a left or right transmission device 7 is illustrated partially according to FIG. 1. In this figure as in all other figures the same parts are given the same reference symbols and are partially explained in more detail only in connection with a figure.

In FIG. 2 the transmission device 7 is accommodated in a transmission housing 52 which also extends parallel to the longitudinal axis 29 according to FIG. 1. In the transmission housing 52 the rotating spindles 30, 31 are arranged with the corresponding screw drive nuts 25, 26 positioned on them. For clarity the screw drive nut 25 is not illustrated in FIG. 2 in conjunction with the rotating spindle 30.

The screw drive nut 26 is rotationally rigidly held in the sliding section 56 of the retaining sleeve 54. The sliding section 56 exhibits, for example, a quadrilateral and especially square cross-section which can be displaced along an appropriately square cross-section of the transmission housing 52. Sliding plates 60 are arranged between the sliding section 56 and the transmission housing 52 on the corresponding outer sides 59 of the sliding section 56 to reduce the friction.

The sliding section 56 is arranged on an end 73 of the retaining sleeve 54 facing the worm gear 11 as transmission unit 8. The said retaining sleeve 54 exhibits a tube section 86 with an essentially circular-shaped cross-section which extends from the sliding section 56 to the free end of the transmission housing 52 where it is brought out. The corresponding end 64 of the tube section 86, see also FIG. 1, can be attached in the yoke 67 in the appropriate hole.

Figure 3:
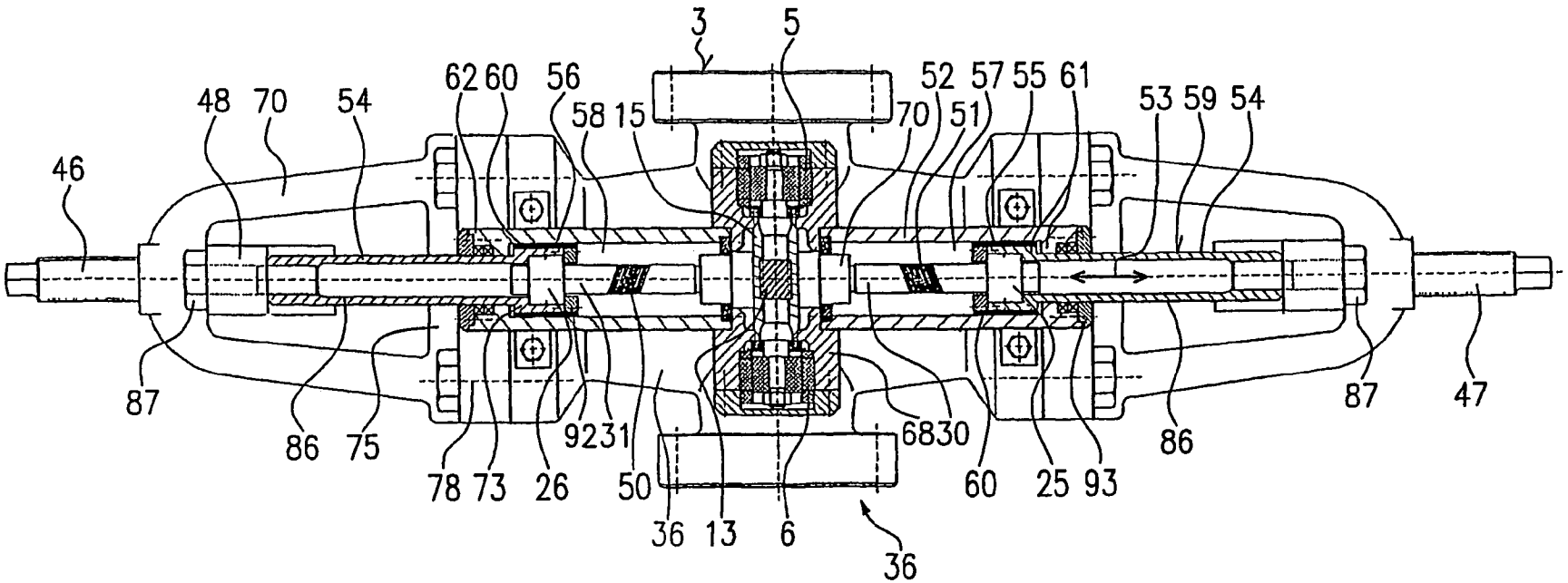
FIG. 3 shows a side view according to FIG. 2 with additional device housing and retaining sleeves.
Figure 4:
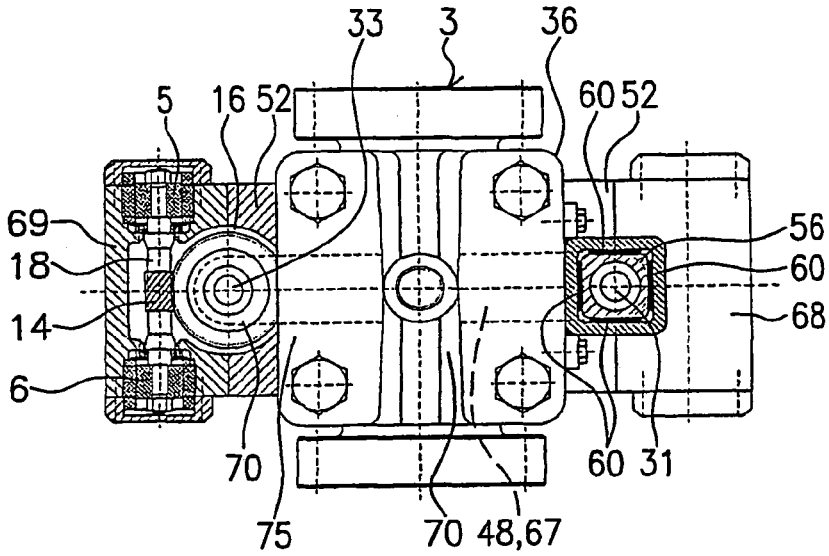
FIG. 4 shows a cross-section through the device housing according to FIG. 3.

At this point it must be noted that all other screw drives and worm drives for the embodiment according to FIG. 1 are constructed analogously to the versions according to FIGS. 2 to 4.

In FIG. 2 the screw drive nut 26 is displaced so far in the direction of the worm drive 11 along the rotating spindle 31 that the retaining sleeve 54 connected to it is drawn as far as possible into the transmission housing 52.

Transverse to the transmission housing 52 a motor housing 68 extends in which the electrical motors 5, 6 are arranged, between which the worm gear 11 extends. The worm gear 11 exhibits the worm 13 arranged on the worm shaft 17, the said worm engaging with its outer teeth the corresponding outer teeth on the worm wheel 15. The corresponding teeth on the worm and worn wheel can be formed such that the worm is a globoid or cylindrical worm or correspondingly the worm wheel is a spur wheel or a globoid wheel. The worm wheel 15 is positioned rotationally rigidly on a connecting rotational sleeve 70 which extends in the longitudinal direction of the rotating spindles 30, 31 and corresponding ends of the rotating spindles 30, 31 are rotationally rigidly mounted in both its ends 71, 72. Appropriate bearings 80, 81 are arranged in the transmission housings 52 at the transition to the corresponding motor housing 68 or 69, see also FIG. 4, for the rotational support of the connecting sleeve 70.

The worm shaft 17 is arranged with each of its shaft ends 19, 20 in one of the electric motors 5, 6 where they are rotationally rigidly attached at their free ends 82, 83 with appropriate nuts 84, 85.

It is pointed out once again that the rotating spindles 30, 31 are formed with opposite running screw pitches 50, 51, so that the corresponding screw drive nuts 25, 26 move in opposite directions along the rotating spindles 30, 31 when the worm wheel 15 rotates.

With regard to the screw drives it is pointed out that these can be ball screw drives or roll screw drives. According to the invention, with the illustrated embodiments roll screw drives and especially planetary roll screw drives are used.

In FIG. 3 a side view analogous to FIG. 2 is illustrated, especially with the device housing 36 and the housing covers 74, 75 mounted on it with appropriate end arms 76, 77.

According to FIG. 3 the two screw drive nuts 26, 25 are displaced as far as possible in the-direction of the yoke 67, respectively the transverse beams 48, 49 within the transmission housing 52. Correspondingly, the tube sections 86 of the retaining sleeves 54 are almost completely pushed out of the transmission housing 52. The tube sections 86 are attached to the transverse beams 48, 49 by the threaded studs 87, see also FIG. 1. In FIG. 3 it can especially be seen that the screw drive nuts 25, 26 are held in the corresponding sliding sections 55, 56 by screwing on a mounting ring 92 in the sliding sections 55, 56 and are arranged there rotationally rigidly.

The transmission housings 52 are closed at their ends positioned remotely from the worm gear 11 by closing caps 93 by screwing to the corresponding ends 61, 62, whereby within these ends appropriate bearings are also arranged for displacing the retaining sleeves 54.

The advance shafts 44, 45 protrude with their end sections 46, 47 outwards beyond the corresponding end arms 76, 77, see also FIG. 1, and, as with the rest of the advance shafts 44, 45 they are arranged offset parallel to the rotating spindles 30 to 33.

In FIG. 4 a section transverse to the illustration according to FIGS. 2 and 3 is shown, whereby the section is positioned on the side of the left transmission device 7, see FIG. 1, through the motor housing and on the right side of the device housing 36 in the direction of the longitudinal axis 29 offset to the motor housing by the corresponding sliding section 56.

In FIG. 4 it can be seen especially that the transmission housing 52 and corresponding motor housing 68, 69 are flange-connected at the side to the device housing 36. The corresponding motor housings 68, 69 are fitted here sideward offset to the outside on the transmission housings 52. The motor housing and transmission housing can also be formed out of one piece.

The worm shaft 18 extends tangentially to the worm wheel 16 and is held rotationally rigidly at both ends in the corresponding electric motors 5 and 6, so that both motors can drive the worm shaft 18 simultaneously and synchronously.

In the region of the sliding section 56 it can be seen from the figures that the said sliding section exhibits an essentially quadratic cross-section arid is guided in a similarly quadratically formed transmission housing 52 in its longitudinal direction. Sliding plates 60 for reducing the friction are arranged between the sliding section 56 or its outer sides and the transmission housing 52.

Figure 5:
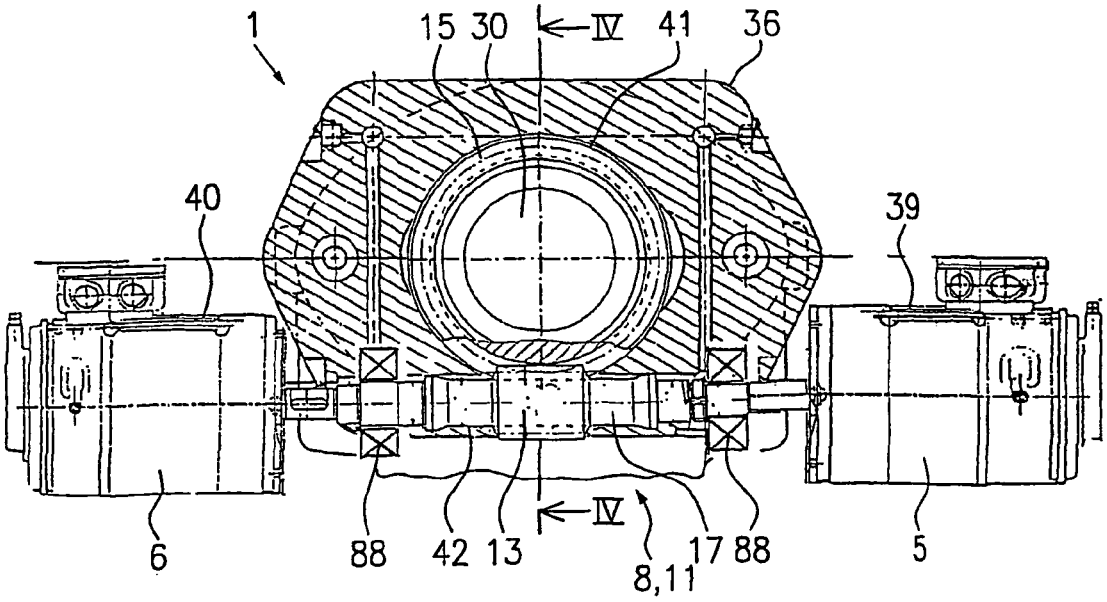
FIG. 5 shows a cross-section through a second embodiment of a blowout valve S assembly.

In FIG. 5 a Section 4 through the device housing 36 is illustrated, see also FIG. 1, for a second embodiment of a blowout valve assembly 1 according to the invention.

This embodiment differs from the previously described embodiment especially in that the screw drive acts directly on the advance shaft and is arranged in the device housing 36. Accordingly, the worm gear is arranged transverse to the longitudinal axis 29, see FIG. 1, of the device housing 36, whereby the worm shaft 17 with worm 13 is appropriately supported rotationally in a transverse hole 42 of the device housing, the said hole extending approximately tangentially to the longitudinal hole 41 or closing hole 90, see FIG. 1. The associated worm wheel 15 is rotationally rigidly connected to the corresponding screw drive nut 25 of the associated screw drive 21. The worm wheel 15, screw drive nut 25 and rotating spindle 30 are arranged concentrically to the corresponding advance shaft 44 or 45, whereby the advance shafts 44, 45 can be formed in this connection also directly by the corresponding rotating spindles. Consequently, the corresponding closing element 34, 43 can be directly attached releasably to the free end of the corresponding rotating spindle via the connection adapter 79 illustrated in FIG. 1.

The worm shaft 17 is brought out at the side from the transverse hole 42 out of the device housing 36 where it is connected to the electric motors 5, 6. These motors are arranged in appropriate motor housings 39, 40. Within the transverse hole the worm shaft 17 is supported rotationally using appropriate bearings 88.

Figure 6:
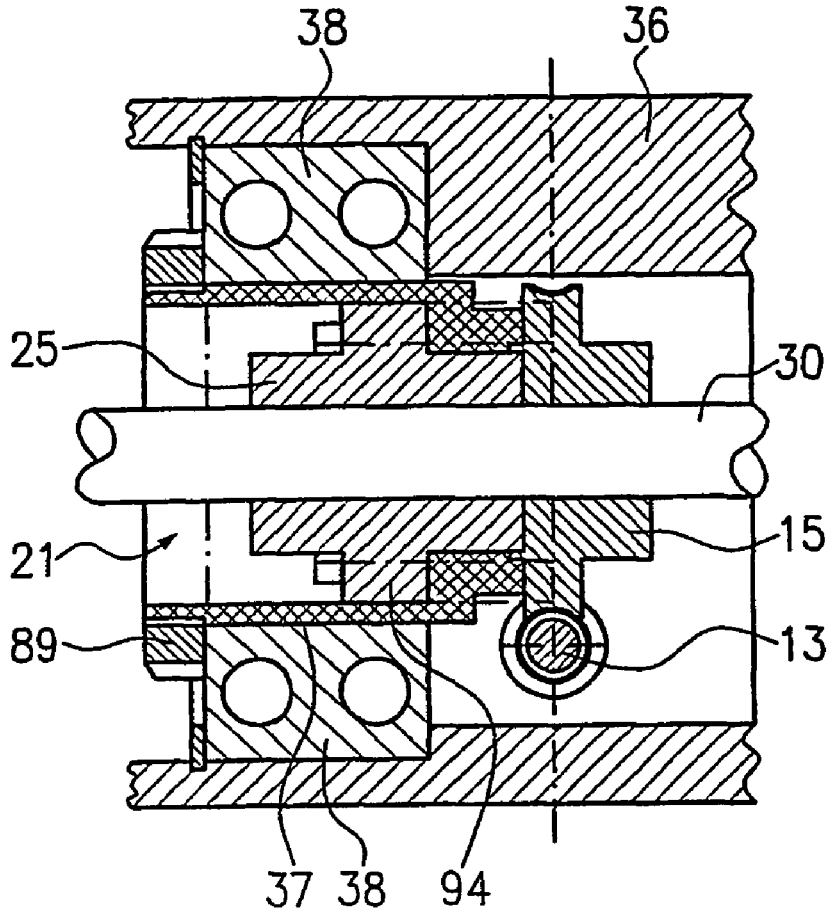
FIG. 6 shows a cross-section along the line VI—VI in FIG. 5.

In FIG. 6 a section along the line VI—VI from FIG. 5 is shown. It should be noted that both advance shafts 44, 45 according to FIG. 1 with the second embodiment according to FIGS. 5 and 6 are driven directly by a suitable screw drive with associated worm gear, whereby at least the screw drives are arranged within the device housing 36.

According to FIG. 6 the screw drive nut 25 is arranged rotationally rigid within a bearing sleeve 37. The screw drive nut comprises a circumferential flange 94 which protrudes radially outwards and which is adjacent to a shoulder of the bearing sleeve 37 which protrudes radially inwards and is attached to it by threaded studs or similar. With the radially inwards-protruding shoulder of the bearing sleeve 37 the worm wheel 15 is attached by screwing on the side opposite the circumferential flange 94.

The rotating spindle 30 is passed through the worm wheel 15 and the screw drive nut 25 and is supported in these rotationally. The rotating spindle 30 can in this connection be connected rotationally rigidly at its end facing the corresponding advance shaft 44, 45 to the said shaft or it can exhibit a connection adapter 79 itself at this free end, see FIG. 1.

The bearing sleeve 37 can be rotated within the device housing 36 using an appropriate axial bearing 38, but is supported without being able to be axially displaced. A threaded ring is screwed onto the bearing sleeve 37 at one end in the axial direction to fix the said bearing sleeve.

The invention claimed is:

1. A blowout valve assembly with a connecting channel, which can be closed by at least one closing device transversally displaced with regard to the connecting channel by means of a drive device, the drive device comprising:

at least two electric motors, which can be operated individually or in a synchronized manner;

a transmission device having at least one irreversible transmission unit being drive-connected to said electric motors and adapted to transversally displace the closing device; and a separate control device electrically connected to each of said electric motors.

2. The blowout valve assembly according to claim 1, wherein said electric motors are servomotors or direct current servomotors.

3. A blowout valve assembly with a connecting channel, which can be closed by at least one closing device transversally displaced with regard to the connecting channel by means of a drive device, the drive device comprising:

at least two electric motors, which can be operated individually or in a synchronized manner;

a transmission device having at least one irreversible transmission unit being drive-connected to said electric motors and adapted to transversally displace the closing device, wherein said transmission device is a worm drive comprising:

a worm wheel connected to the closing device; and a worm connected to said electric motors, wherein the worm is disposed on a worm shaft that is drive-connected to at least one of said electric motors.

4. The blowout valve assembly according to claim 3, wherein one of said electric motors is drive-connected to each end of the worm shaft.

5. The blowout valve assembly according to claim 4, wherein each end of the worm shaft is rotationally rigidly connected to a motor shaft of one of said electric motors.

6. The blowout valve assembly according to claim 3 wherein the transmission device further comprises a screw drive including a screw drive nut and a rotating spindle, wherein the worm wheel is rotationally rigidly connected to either the screw drive nut or the rotating spindle.

7. The blowout valve assembly according to claim 6, wherein the screw drive is a ball screw drive.

8. The blowout valve assembly according to claim 6, wherein the screw drive is a roll screw drive.

9. The blowout valve assembly according to claim 8, wherein the roll screw drive is a planetary roll screw drive.

10. The blowout valve assembly according to one claim 6, wherein the rotating spindle is connected to a closing element of the closing device.

11. The blowout valve assembly according to claim 10, wherein the rotating spindle is formed as part of the closing device and includes the closing element at its end facing the connecting channel.

12. The blowout valve assembly according to claim 6, wherein the screw drive nut is adapted to be rotated in a device housing, but is supported so that it cannot be axially displaced.

13. The blowout valve assembly according to claim 6, wherein the screw drive nut is arranged rotationally rigidly in a bearing sleeve, which can be rotated in a device housing, but is supported so that it cannot be axially displaced.

14. The blowout valve assembly according to claim 13, wherein the worm wheel is rotationally rigidly connected to the screw drive nut and/or bearing sleeve.

15. The blowout valve assembly according to claim 14, wherein the bearing sleeve is supported by at least one axial bearing in the device housing such that it cannot be rotated.

16. The blowout valve assembly according to claim 13, wherein said electric motors are arranged on both sides of the device housing, especially on motor housings which can be flange-connected to the said device housing.

17. The blowout valve assembly according to claim 13, wherein the worm shaft is rotationally supported in a transverse hole, running approximately tangentially to the longitudinal hole of the device housing, the said longitudinal hole accommodating the rotating spindle and screw drive nut.

18. The blowout valve assembly according to claim 13, further comprising two closing elements, displaceable towards one another, supported in the device housing; and wherein at least one screw drive, one worm gear and two electric motors are assigned to each closing element.

19. The blowout valve assembly according to claim 18, wherein each closing element is connected to an advance shaft, especially in a releasable manner, which is connected at its end section, facing away from the closing element, to a transverse beam which is transverse to the longitudinal axis of the advance shaft, the said transverse beam being connected, on both sides of the advance shaft, to a left and a right screw drive.

20. The blowout valve assembly according to claim 19, wherein a worm gear and two electric motors are assigned to each of the left and right screw drives.

21. The blowout valve assembly according to claim 20, wherein the worm wheel is arranged approximately centrally between two rotating spindles and is rotationally rigidly connected to them, whereby the screw pitches of the rotating spindles are in opposite directions and a screw drive nut is arranged on each rotating spindle, the said screw drive nut being movement-connected to the transverse beam.

22. The blowout valve assembly according to claim 21, wherein the screw drive nut is guided along the rotating spindle in a transmission housing rotationally rigidly in the longitudinal direction of the rotating spindle.

23. The blowout valve assembly according to claim 22, wherein the screw drive nut is fixed in a tube-shaped retaining sleeve, which comprises at least one rotationally rigid sliding section which can be displaced along the transmission housing.

24. The blowout valve assembly according to claim 23, wherein the sliding section is formed on the end of the retaining sleeve facing towards the rotating spindle and the screw drive nut is held rotationally rigidly in it.

25. The blowout valve assembly according to claim 24, wherein the sliding section is essentially quadrilateral corresponding to a cross-section of a guide hole of the transmission housing.

26. The blowout valve assembly according to claim 25, further comprising sliding plates arranged especially on all four outer sides of the sliding section.

27. The blowout valve assembly according to claim 26, wherein the retaining sleeve exhibits an essentially circular cross-section except for its sliding section and protrudes from one end of the transmission housing and is here especially releasably attached by its free end to the transverse beam.

28. The blowout valve assembly according to claim 27, wherein the free ends of the retaining sleeve and the transverse beam are screwed together.

29. The blowout valve assembly according to claim 28, wherein the transverse beam is formed as a yoke.

30. The blowout valve assembly according to claim 29, wherein the electric motors are arranged in a motor housing extending transversally and essentially tangentially to the transmission housing.

31. The blowout valve assembly according to claim 30, wherein the worm wheel is arranged rotationally rigidly on a connecting rotational sleeve and ends of the rotating spindle with opposing screw pitch are attached to its both ends.

32. The blowout valve assembly according to claim 31, wherein the electric motors are synchronized by software.

33. The blowout valve assembly according to claim 32, wherein at least one electric motor is wired as master and, where applicable, the remaining electric motors are wired as slaves.

34. A blowout valve assembly comprising:

a closing device transversely displaceable relative to a connecting channel disposed within the blowout valve;

a transverse beam connected to a shaft that is coupled to said closing device;

a first transmission device coupled to a first end of said transverse beam, wherein said first transmission device is drive connected to a first electric motor; and a second transmission device coupled to a second end of said transverse beam, wherein said second transmission device is drive connected to a second electric motor, wherein said first and second transmission devices are operable to transversely displace said closing device relative to the connecting channel.

35. The blowout valve assembly of claim 34 wherein said first transmission device comprises:

a worm drive that is drive connected to said first electric motor; and a screw drive connected to said worm drive and to said transverse beam, wherein said worm drive and said screw drive transform rotational motion of said first electric motor into linear motion of said transverse beam.

36. The blowout valve assembly of claim 35 wherein said worm drive comprises:

a worm mounted on a shaft that is drive coupled to said first electric motor; and a worm wheel engaged with said worm and rotationally rigidly connected to said screw drive.

37. The blowout valve assembly of claim 36 wherein said screw drive comprises:

a screw drive nut coupled to said transverse beam; and a rotating spindle engaged with said screw drive nut and rotationally rigidly connected to said worm drive.

38. The blowout preventer of claim 35 wherein said worm drive is further connected to a third electric motor.

* * * * *